United States Patent [19]

Myers

[11] 4,097,833

[45] Jun. 27, 1978

[54] ELECTROMAGNETIC ACTUATOR

[75] Inventor: John L. Myers, Dayton, Ohio

[73] Assignee: Ledex, Inc., Dayton, Ohio

[21] Appl. No.: 656,748

[22] Filed: Feb. 9, 1976

[51] Int. Cl.[2] ..... H01F 7/08

[52] U.S. Cl. ..... 335/261; 335/266; 335/268

[58] Field of Search ..... 335/256, 258, 261, 262, 335/268, 279, 251, 269, 231, 266

[56] References Cited

U.S. PATENT DOCUMENTS

| | | | |
|---|---|---|---|
| 1,878,919 | 9/1932 | Van Dam et al. | 335/231 |
| 2,274,775 | 3/1942 | Cox | 335/266 X |
| 2,690,529 | 9/1954 | Lindblad | 335/256 X |
| 2,992,304 | 7/1961 | Andrews | 335/261 |
| 3,070,730 | 12/1962 | Gray et al. | 335/256 X |
| 3,241,006 | 3/1966 | Boyko | 335/279 X |
| 3,503,022 | 3/1970 | Burdett | 335/266 X |

*Primary Examiner*—George Harris

*Attorney, Agent, or Firm*—Biebel, French & Nauman

[57] ABSTRACT

An electromagnetic device includes a stator having a first closed flux carrying path including a core and an air gap opening in the core. Flux is generated in the flux carrying path by a coil, with the direction of flux flow across the air gap being perpendicular to pole surfaces defining the air gap. An armature is mounted to be movable between the pole surfaces and to overlap varying areas of the pole surfaces in dependence upon the position of the armature. The overlap areas are directly proportional to the position of the armature. In one embodiment a bi-directional device having two such closed flux carrying path simultaneously acts on a single armature. The equilibrium position of the armature is dependent on the relative flux flow through the two flux carrying paths. A further embodiment is disclosed in which an air gap opening is inclined to the direction of flux flow in the core of the flux path. The area of each pole surface defining the inclined air gap exceeds the cross-sectional area of the core.

10 Claims, 16 Drawing Figures

ELECTROMAGNETIC ACTUATOR

BACKGROUND OF THE INVENTION

The present invention relates to an electromagnetic device which converts electrical energy into mechanical energy. Solenoid devices have long been known and used where a movable element or armature is desired to be moved between two positions in response to the application of electrical energy. Solenoids, however, are generally capable of moving an armature to only two discrete positions, and further, the speed of operation of such devices is limited by the mass of the armature. These disadvantages have been due in part to the use in such devices of an air gap varying in length with the armature movement. Almost all such devices have used an armature moving parallel to the direction of magnetic flux flow.

One approach taken to the problem of a multi-position electromagnetic device is shown in U.S. Pat. No. 3,867,676 to Chai et al., issued Feb. 18, 1975. A series of windings are energized to move a linear step motor to a discrete number of positions. Such a device is positionable to only a discrete number of locations, however, and further, due to the massive construction of the armature, provides relatively slow speed operation.

Variable reluctance devices, per se, are known, as shown in U.S. Pat. No. 2,869,048 to Reed, issued Jan. 13, 1959, and U.S. Pat. No. 2,811,680 to Stoecklin et al., issued Oct. 29, 1957. Both of these references show an armature movable between pole faces which define an air gap such that the overlapping areas between the pole faces and the armature change with respect to the movement of the armature. The variation in the overlapping areas is not linear with respect to armature movement, however. The use of a variable reluctance device in a rotating electromagnetic device is old as shown by U.S. Pat. No. 3,435,394, To Egger, issued Mar. 25, 1969 and assigned to the assignee of the present invention; U.S. Pat. No. 3,750,065, to Myers, issued July 31, 1973, and assigned to the assignee of the present invention; U.S. Pat. No. 3,753,180, to Sommer, issued Aug. 14, 1973, and assigned to the assignee of the present invention; and, U.S. Pat. No. 3,870,931, to Myers, issued Mar. 11, 1975, and assigned to the assignee of the present invention. In some of the rotary devices there disclosed, the variation in the overlapping areas between the pole faces and the armature is linear with respect to angular displacement of the armature.

Proportional bi-directional solenoids have also been known in the past. U.S. Pat. No. 3,900,822, issued Aug. 19, 1974 to Hardwick et al., U.S. Pat.No. 3,870,931, issued Mar. 11, 1975 to Myers, both assigned to the assignee of the present invention, disclose a solenoid having an armature movable to a number of positions in response to the flux generated in more than one flux path. Since, however, flux flow does not remain perpendicular to the pole faces defining the air gaps, but travels laterally through a portion of the armature, saturation of the armature limits flux flow and correspondingly the forces which may be generated by the solenoid. If the armature is made larger to accommodate greater flux flow, the greater inertia of the armature will prevent rapid actuation.

SUMMARY OF THE INVENTION

An electromagnetic device has a stator means comprising a first closed flux carrying path including a core and an air gap opening in the core, the air gap opening defined by first and second parallel pole surfaces; coil means for generating electromagnetic flux in the closed flux carrying path, with the direction of flux flow across the air gap being perpendicular to the pole surfaces; and, armature means mounted on the electromagnetic device to be movable between the pole surfaces in a plane parallel to those surfaces and to overlap varying areas of the pole surfaces in dependence upon the position of the armature means, the overlap areas being directly proportional to the position of the armature means.

The present invention may further include a second closed flux carrying path having a core and an air gap opening in the core defined by third and fourth parallel pole surfaces and having means for generating flux in this second path. The armature means is arranged to be movable in the air gaps in the first and second closed flux carrying paths so as to overlap portions of both sets of pole surfaces simultaneously. Flux is generated in the first and second flux carrying paths so that the armature tends to be pulled into both air gaps simultaneously. The resulting position of the armature is therefore a function of the flux in both flux paths.

In order to increase the range of movement of an armature in the device of the present invention, an air gap opening may be positioned to be inclined to the direction of flux flow in the core of the flux path. With such an arrangement the area of each pole surface defining the air gap exceeds the cross-sectional area of the core taken along a plane perpendicular to the direction of flux flow in the core. The direction of flux flow across the air gap is perpendicular to the pole surfaces.

Accordingly, it is an object of this invention to provide an electromagnetic actuator device operable on a variable reluctance principle and having parallel pole surfaces overlapped by an armature; to provide such a device in which plural flux paths and air gaps are simultaneously operable upon the armature so that it may be moved to an unlimited number of positions; to provide such a device in which the pole surfaces defining an air gap are inclined to the direction of flux flow to increase the range of positions through which the armature may be moved; and further to provide such a device in which the armature has a low inertia, permitting high operating speeds.

Other objects and advantages of the present invention will be apparent from the following description, the accompanying drawings and the appended claims.

DETAILED DESCRIPTION OF THE INVENTION

The present invention relates to an electromechanical actuator. In such a device, mechanical energy is produced from electrical energy by means of a coupling magnetic field. Generally, in an electrical system, $$p = ei = (dw,/dt)$$

where $p$ = power, $e$ = voltage, $i$ = current, $w$ = energy and $t$ = time.

Therefore, $dw = eidt$.

Since by Faraday's Law, $e = (Nd\phi dt)$, where $N$ = number of turns and $\phi$ = magnetic flux, $$dw = \left(\frac{Nd\phi}{dt}\right)idt, \text{ and}$$

$dw = Nid\phi$, and thus $dw = Fd\phi$, where $F$ = magnetomotive force = $ni$.

Therefore, $w = \int Fd\phi$. (1)

Equation (1) gives the fundamental relationship between magnetomotive force, flux and energy in a magnetic device. To solve equation (1) and find energy W in a magnetic circuit, the variable $\phi$ is first determined as a function of $i$, and then integrated, either mathematically or graphically. For example, a linear magnetic circuit has a solution as follows:

$$\phi = \frac{F}{R} - \frac{N1}{\frac{1}{\mu A}} - \left(\frac{N\mu A}{1}\right)i, \text{ where } \mu \text{ is the permeability}$$

where $\mu$ is the permeability of the ciruit, $l$ is the length of the circuit, and $A$ is the cross-sectional area of the circuit.

$$\text{Therefore, } d\phi = \left(\frac{N\mu A}{1}\right)di.$$

$$W = \int Fd\phi = \int Nid\phi = \int Ni\left(\frac{N\mu A}{1}\right)di.$$

-continued $$\text{And } W = \left(\frac{N^2\mu A}{1}\right)\int_0^I idi = \left(\frac{N^2\mu A}{1}\right)\frac{I^2}{2}.$$

The constant $$\left(\frac{N^2\mu A}{1}\right)$$

is the inductance, L, of the circuit.

Hence, $$W = LI^2/2 \quad (2)$$

which is the familiar energy equation for energy storage in an inductor.

Figure 1:
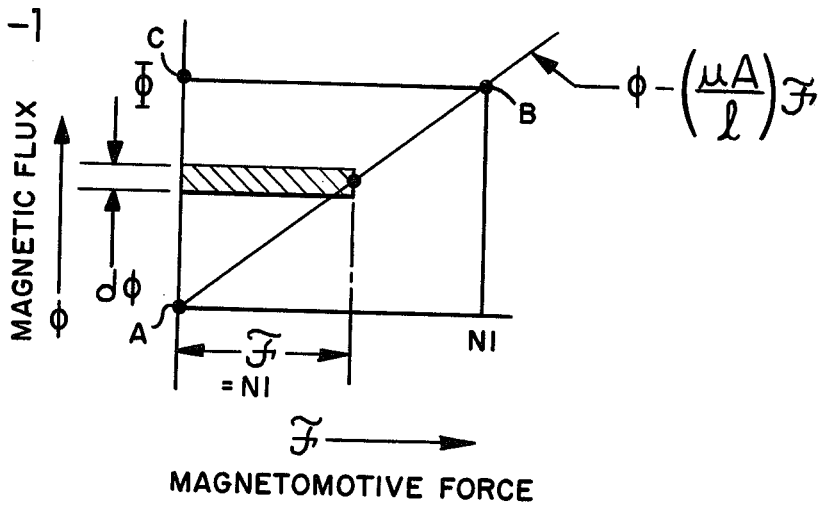
FIG. 1 is a graph of magnetic flux presented as a function of magnetomotive force for a linear system, useful in understanding the present invention.

Referring now to FIG. 1, a graph of flux ($\phi$) is plotted as a function of magnetomotive force (F) for a linear system. The shaded area is the differential quantity of energy $dw = Fd\phi$, and the total energy is the area ABCA between the $\phi$ curve and the vertical $\phi$ axis. This area is equal to $$\int_0^{NI} Fd\phi.$$

Graphically, this is equivalent to the area of a triangle with a base NI and height $$\phi = \left(\frac{\mu A}{1}\right)NI.$$

Therefore, $$A = \frac{1}{2}bh$$

$$A = \frac{1}{2}(NI)(NI)\frac{\mu A}{1}$$

$$A = \left(\frac{N^2\mu A}{1}\right)\frac{I^2}{2}, \text{ and}$$

$$A = \frac{LI^2}{2}, \text{ which agrees with equation (2), above.}$$

Figure 2A:
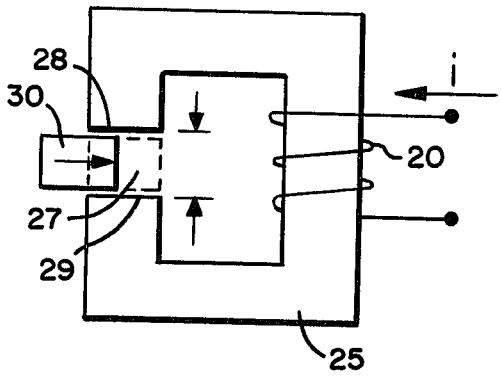
FIG. 2A is a diagrammatic representation of a nonlinear magnetic circuit.
Figure 2B:
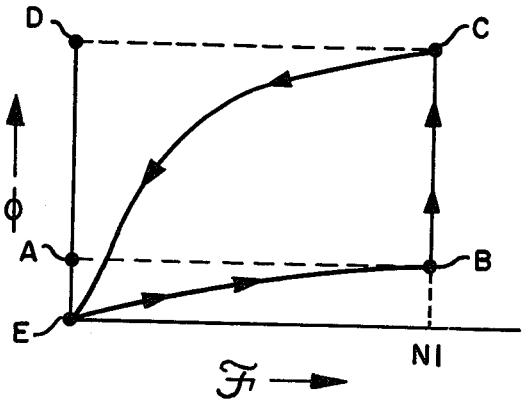
FIG. 2B is a graph showing the flux versus magnetomotive force characteristic of the device of FIG. 2A.

A nonlinear magnetic circuit and its associated flux versus magnetomotive force curve are shown in FIGS. 2A and 2B. Starting with $i$ = 0 amperes (point E), current is increased in the coil means 20 to a value of I amperes (point B) causing flux to flow through a stator means including a core 25 and an air gap opening 27 defined by first and second parallel pole surfaces 28 and 29. The energy stored is then the area of the triangle ABEA. An armature means 30 is movable between the pole surfaces 28 and 29 in a plane parallel to these surfaces to overlap varying areas of the pole surfaces in dependence upon the position of the armature means 30. If the armature means 30 is slowly inserted into the air gap 27, an additional amount of energy depicted as area ABCDA is introduced into the system. If the current is then reduce to zero, $\phi$ will vary along curve CE and an amount of energy equal to the area CDEC will be returned to the electrical system. Therefore, the area EBCE represents work that was performed on the armature 30, plus any energy losses in the ferromagnetic material of the core 25 and armature 30. Work was performed on the armature by means of the magnetic flux $\phi$ involved, and it can be shown that the force exerted on the armature depends on the rate that the energy associated with the magnetic circuit is changing with respect to the displacement of the armature. Stated concisely, the force vector equals the gradient of the associated energy function:

$$F = \nabla W \tag{3}$$

Therefore, for an actuator to have a high magnetic efficacy, curve EB should be of as low value as possible, and curve EC should be as high as possible. Stated in other terms, with the armature or moving member in the initial position, the device should have an extremely poor (high reluctance) magnetic circuit, and with the armature in the final position the device should have the very best (lowest reluctance) magnetic circuit possible. The work output or average force produced by the device depends directly on the magnitude of the difference between these two states of the device.

Figure 3A:
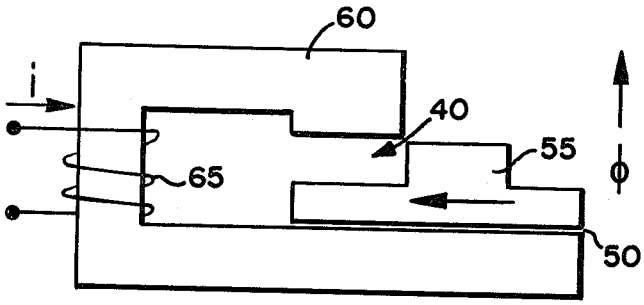
FIG. 3A is a diagrammatic representation of a nonlinear magnetic circuit illustrating the present invention.
Figure 3B:
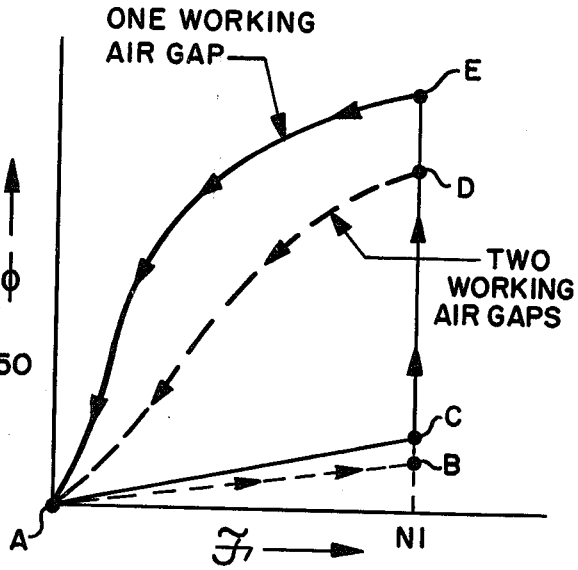
FIG. 3B is a graph showing the flux versus magnetomotive force characteristic of the device of FIG. 3A.

In the configuration of FIG. 2A, as the armature moves, the magnetic circuit is changing because each half of the relatively large major air gap 27 is being replaced by an extremely short minor air gap. Since this change in the magnetic circuit condition results directly in work output to the armature 30, the two minor air gaps can properly be called working air gaps. By contrast, one flux-carrying or non-working air gap may be used. A configuration is shown in FIG. 3A which uses one working air gap and one flux-carrying gap. As seen in FIG. 3B, this arrangement offers an increased force output due to the fact that area ACDEA is greater than area ABCDA.

Figure 4:
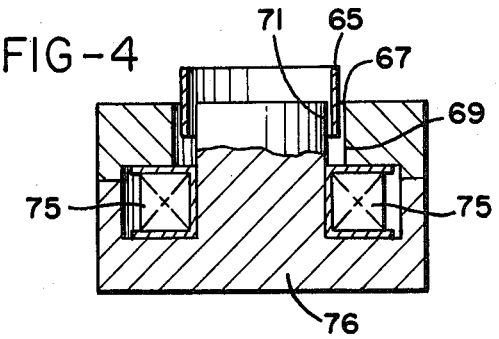
FIG. 4 is an axial sectional view of one embodiment of the present invention.
Figure 5:
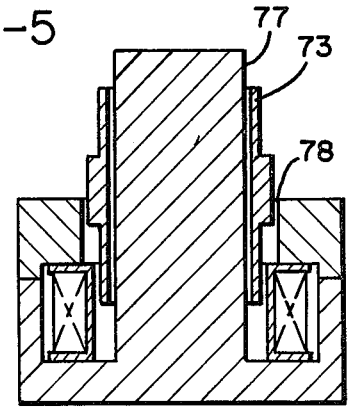
FIG. 5 is an axial sectional view of an embodiment of the invention similar to FIG. 4 which uses both working and non-working air gaps.

Referring now to FIG. 4, there is shown what may be termed a "voice coil" embodiment of the present invention. An annular armature 65 is positioned to be movable vertically in an annular air gap 67 defined by pole surfaces 69 and 71. A coil 75, when energized, generates a magnetic flux in core 76 which flows across air gap 67 perpendicularly to armature 65. As can be seen from the drawing, this device uses two working air gaps. In FIG. 5 a sectional view of an embodiment similar to that shown in FIG. 4 is shown. Annular armature 73, however, is shaped so that the air gap adjacent pole 78 is a working air gap while the air gap adjacent pole 77 is a non-working air gap.

Figure 6:
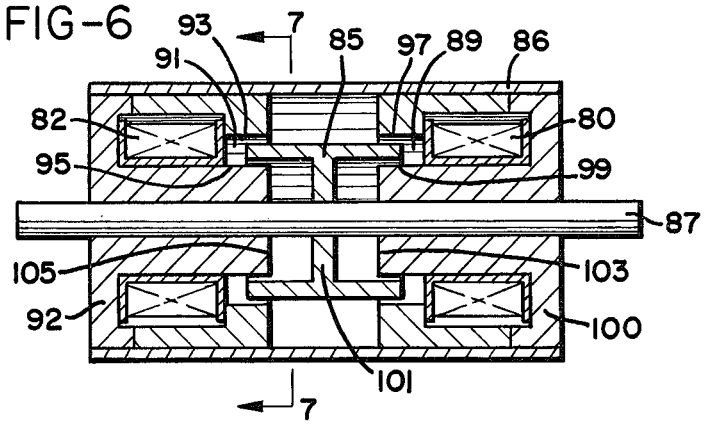
FIG. 6 is an axial sectional view of a bi-directional embodiment of the present invention.
Figure 7:
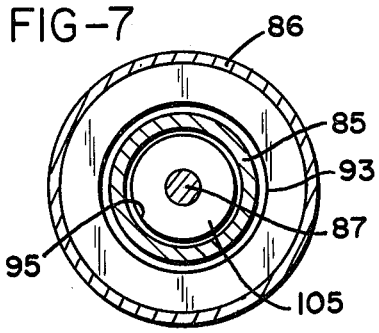
FIG. 7 is a sectional view taken generally along line 7—7 in FIG. 6.

FIGS. 6 and 7 show and embodiment of the present invention operable to move an armature to an unlimited number of positions in either direction. This bi-direction feature of the device is accomplished by the use of two flux generating coils 80 and 82 operating so as to apply opposing forces to armature 85. Armature 85 is journalled on rod 87 which passes through a central opening in the armature. Rod 87 may typically be constructed of a non-magnetic material and is utilized only to transmit the motion of the armature 85 to the exterior of the electromagnetic device. As may be seen by a comparison of FIG. 6 with FIG. 4, the embodiment of FIG. 6 is similar to two "voice coil" devices operating in opposition to each other. An annular casing 86 surrounds the device and maintains proper positioning between parts for operation. Armature 85 is positioned so as to extend into air gaps 89 and 91. Coil 82 when energized causes flux to flow through core 92 generally perpendicularly to poles 93 and 95 across air gap 91. This creates a force acting on armature 85 tending to pull it into air gap 91. In like manner armature 85 is drawn into annular air gap 89 which is defined by pole surfaces 97 and 99 when coil 80 is energized causing flux to flow in core 100. Armature 85 is appropriately shaped so that even at its extreme limit of travel in either direction web 101 will not be sufficiently close to core surfaces 103 or 105 for a significant force to be generated due to a flux leakage from either surface.

Figure 8:
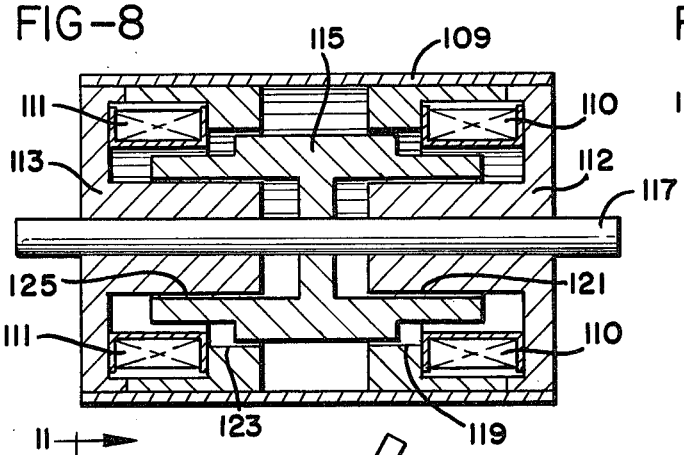
FIG. 8 is an axial sectional view showing an embodiment of the invention similar to FIG. 6, which uses both working and non-working air gaps.

Referring now to FIG. 8, there is shown an embodiment of the invention similar to that shown in FIG. 6. Annular casing 109 encircles coils 110 and 111 and cores 112 and 113. Coils 110 and 111 are simultaneously energized so as to exert opposing forces upon armature 115. Armature 115 is journalled on and connected to rod 117 which may typically be made of a non-magnetic material which does not affect the magnetic circuit operation of the device. Coil 110 generates flux in core 112 which passes through the air gap between pole surfaces 119 and 121 perpendicularly to the armature 115. In like fashion coil 111 causes flux to flow in core 113 and through an air gap defined by pole surfaces 123 and 125. It is recognized that the air gaps between pole surfaces 121 and armature 115 and between pole surface 125 and armature 115 are not completely non-working air gaps. As seen in FIG. 5, the reluctance of the gap between armature 73 and pole surface 77 is constant over the range of armature travel. The "non-working" air gaps of FIG. 8 do, however, change reluctance as the armature 115 is moved to various positions. However, the areas of overlap between armature 115 and pole surfaces of the non-working air gaps are sufficiently large that an incremental change in displacement of the armature 115 and rod 117 results in a negligible reluctance change in these air gaps.

Figure 9:
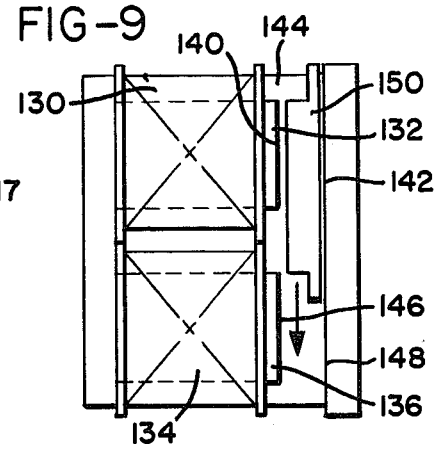
FIG. 9 is a plan view of a bi-directional embodiment of the present invention using working and non-working air gaps.

FIG. 9 illustrates a further embodiment of the invention of rectangular design. Coil 130 encircles stator core 132. Coil 134 encircles stator core 136. Coil 130 causes electromagnetic flux to flow in a first closed flux carrying path which includes an air gap opening defined by pole faces 140 and 142. The return path for the flux is by way of stator core element 144. Similarly, the stator means further comprises a second closed flux carrying path which includes an air gap opening in core 136 defined by third and fourth parallel pole surfaces 146 and 148. Armature means 150 is movable between the first and second parallel pole surfaces 140 and 142 and also between the third and fourth parallel pole surfaces 146 and 148 so as to overlap varying areas of the first and second pole surfaces and third and fourth parallel pole surfaces simultaneously. As the armature moves into and out of the two air gaps, the overlap area between the pole surfaces and the armature means is directly proportional to the position of armature means 150. The armature 150 and pole surfaces 142 and 148 define non-working air gaps.

Figure 10:
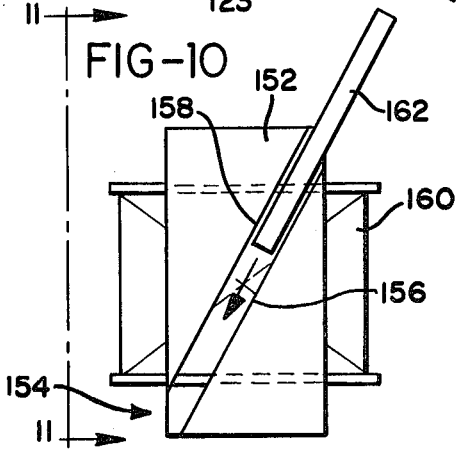
FIG. 10 is an elevational view of a further embodiment of the invention.
Figure 11:
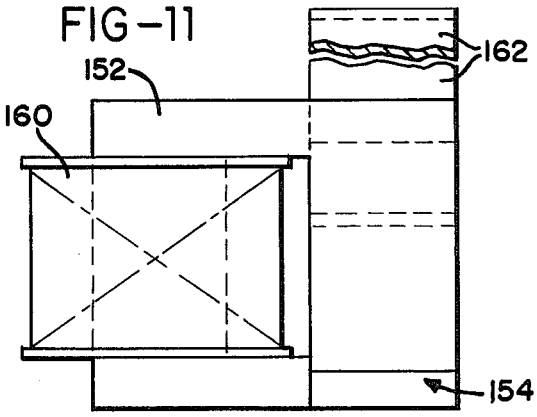
FIG. 11 is a side view of the embodiment of FIG. 10 taken generally along line 11—11.

Referring now to FIGS. 10 and 11, there is shown a further embodiment of the present invention. Stator means 152 comprises a first closed flux carrying path including a core and air gap opening 154 defined by first and second parallel pole surfaces 156 and 158. Coil means 160 when energized generates an electromagnetic flux in the first closed flux carrying path which flows in a direction generally parallel to the exterior surfaces of the core. The flux flow across air gap opening 154 however is in a direction perpendicular to surfaces 156 and 158. Thus it is clear that the pole surfaces are inclined to the direction of flux flow in the core so that the area of each of the pole surfaces exceeds the cross-sectional area of the core taken along a plane perpendicular to the direction of flux flow in the core. This inclined air gap configuration results in armature means 162 having a greater range of positions than if the air gap opening 154 were perpendicular to the direction of flux flow in the core. Also, since reluctance is inversely proportional to area, this configuration offers an improved energized air gap condition, resulting in higher efficiency.

Figure 12:
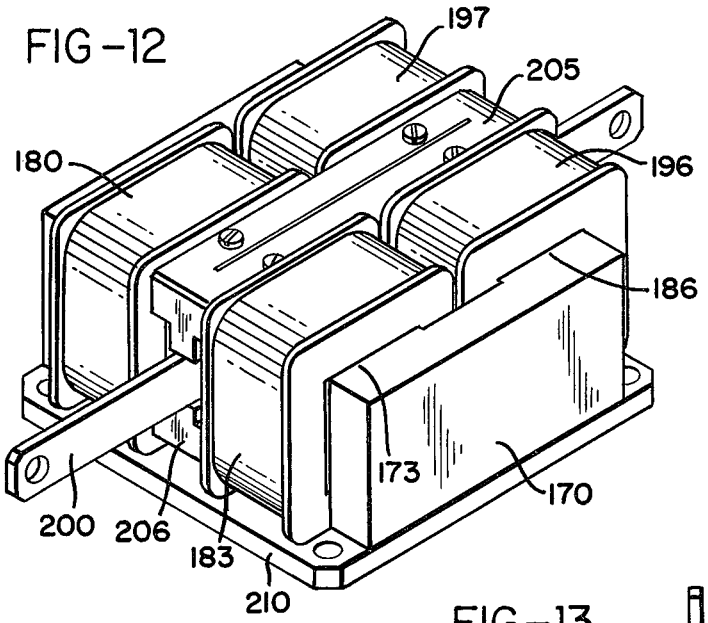
FIG. 12 is a perspective view of a rectangular bi-directional embodiment of the present invention.
Figure 14:
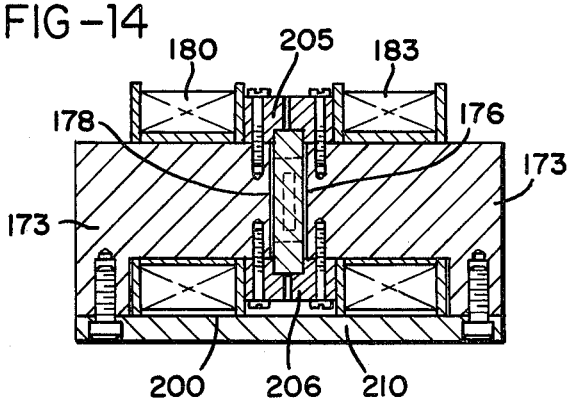
FIG. 14 is a sectional view taken generally along line 14—14 in FIG. 13.
Figure 13:
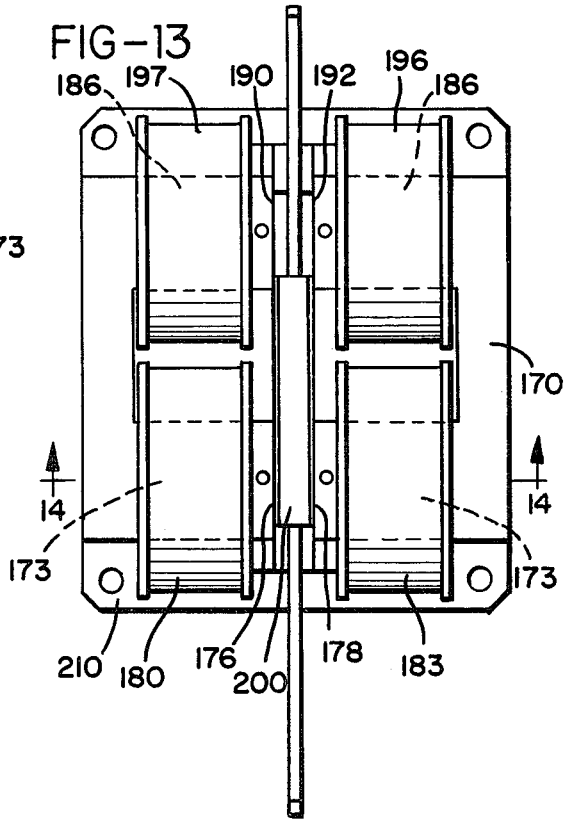
FIG. 13 is a plan elevational view of the embodiment of FIG. 12.

Referring now to FIG. 12 there is shown in perspective a bi-directional rectangular electromagnetic device constructed according to the invention. FIG. 13 is a plan elevational view with the upper armature guide removed. FIG. 14 is a sectional view taken generally along line 14—14 in FIG. 13. A stator means 170 comprises a first closed flux carrying path including a core 173 and an air gap defined by first and second parallel pole surfaces 176 and 178. A coil means for generating electromagnetic flux in the first closed flux carrying path comprises coils 180 and 183. These coils are serially connected so as to generate a flux flow in the same direction through core 173. The use of two separate coils for a single flux path improves the heat dissipation characteristics of the device and decreases fringing of the magnetic field.

A second closed flux carrying path includes a core 186 and air gap opening in the core defined by third and fourth parallel pole surfaces 190 and 192. Coils 196 and 197 generate flux in the second closed flux carrying path. An armature means 200 is mounted to be movable between the first and second parallel pole surfaces 176 and 178 and the third and fourth parallel pole surfaces 190 and 192. As seen in FIG. 12, guide means 205 and 206 are provided to accurately position the armature means 200 in the air gaps. The flux return path for both closed flux carrying paths is through plate 210.

Operation of the device is similar to that previously described with respect to the embodiments of FIGS. 6 and 8. Armature 200 will tend to be drawn into an air gap as the coils associated with the gap are energized. By energizing both sets of coils simultaneously oppositely acting forces are applied to the armature. These forces will generally be linearly dependent upon the position of the armature in the air gaps. The armature will therefore be moved to an equilibrium position at which the oppositely acting forces are balanced. The device shown in FIGS. 12–14 is therefore capable of assuming an unlimited number of positions in response to the appropriate application of power to its respective coils.

The rectangular construction of the device of FIGS. 12–14 may be less expensive to manufacture than a cylindrical configuration. Additionally, laminated construction may be more easily obtained with a rectangular device, thus permitting improvement in frequency response. All of the embodiments of the invention, however, have the distinct advantage that the direction of flux flow through the armature is perpendicular to its direction of movement. The armature may thus be constructed of relatively thin material. This allows for high speed operation and also permits the armature to carry a large amount of flux without saturating.

While the forms of apparatus and method of operation herein described constitute preferred embodiments of the invention, it is to be understood that the invention is not limited to these precise forms of apparatus and method, and that changes may be made therein without departing from the scope of the invention.

What is claimed is:

1. An electromagnetic device comprising:

stator means comprising a first closed flux-carrying path including a core and an air gap opening in said core defined by first and second substantially parallel pole surfaces and a second closed flux-carrying path including a core and an air gap opening in said core defined by third and fourth substantially parallel pole surfaces, coil means comprising means for generating electromagnetic flux in said first and second closed flux carrying paths, the direction of flux flow across said air gaps being substantially perpendicular to said pole surfaces, and armature means mounted on said device to be movable between said first and second pole surfaces and between said third and fourth pole surfaces in a plane substantially parallel to said pole surfaces to overlap simultaneously varying areas of said first and second pole surfaces and said third and fourth pole surfaces in dependence upon the position of said armature means and to conduct therethrough varying portions of the flux in said first and second closed flux-carrying paths, the direction of flux flow in said armature means remaining substantially perpendicular to said pole surfaces.

2. The electromagnetic device of claim 1 wherein said coil means is operable to generate flux in said first flux carrying path and said second flux carrying path providing for either individual or simultaneous flux flow in said first and second flux carrying paths to cause said armature means to move between said pole surfaces to an unlimited number of positions in response to the relative amounts of flux in said first and second flux carrying paths.

3. The electromagnetic device of claim 2 wherein said armature means comprises a rectangular element of magnetic material held by guide means between said first, second, third and fourth pole surfaces, said means for generating electromagnetic flux in said first closed flux carrying path comprises a plurality of separate coils, and said means for generating flux in said second closed flux carrying path comprises a plurality of separate coils.

4. The electromagnetic device of claim 1 wherein the air gaps in said first flux carrying path and said second closed flux carrying path are annular and wherein said armature means is annular.

5. The electromagnetic device of claim 4 wherein said armature means is appropriately shaped such that the overlap area between said armature means and said first pole surface and the overlap area between said armature means and said third pole surface are substantially independent of the position of said armature means.

6. An electromagnetic device compising:

stator means comprising a first closed flux-carrying path including a core and an air gap opening in said core, said air gap opening defined by first and second substantially parallel pole surfaces, coil means comprising means for generating electromagnetic flux in said first closed flux carrying path, the direction of flux flow across said air gap being generally perpendicular to said pole surfaces and the direction of flux flow in said core being inclined to said pole surfaces, and armature means mounted on said device to be movable between said pole surfaces in a plane substantially parallel to said surfaces to overlap varying areas of said pole surfaces in dependence upon the position of said armature means, and to conduct therethrough varying portions of the flux in said first closed flux carrying path, the direction of flux flow in said armature means remaining substantial perpendicular to said pole surfaces, the area of each of said pole surfaces exceeding the cross-sectional area of said core taken along a plane perpendicular to the direction of flux flow in said core.

7. An electromagnetic device comprising:

stator means comprising a first closed flux-carrying path including a core and an air gap opening in said core, said air gap opening defined by first and second substantially parallel pole surfaces, coil means comprising means for generating electromagnetic flux in said first closed flux carrying path, the direction of flux flow across said air gap being generally perpendicular to said pole surfaces, and armature means mounted on said device to be movable between said pole surfaces in a plane substantially perpendicular to the direction of flux flow across said air gap to overlap varying areas of said second pole surface in dependence upon the position of said armature means, the overlap area between said armature means and said first pole surface being independent of the position of said armature means.

8. The electromagnetic device of claim 7 in which said air gap opening is annular and said armature means is annular.

9. An electromagnetic device comprising:

stator means comprising a first closed flux-carrying path including a core and an annular air gap opening in said core, and said air gap opening defined by first and second annular pole surfaces, the distance between said pole surfaces being uniform, coil means comprising means for generating electromagnetic flux in said first closed flux carrying path, the direction of flux flow across said air gap being generally perpendicular to said pole surfaces, and annular armature means mounted on said device to be movable between said pole surfaces in a direction substantially parallel to said surfaces to overlap varying areas of said pole surfaces in dependence upon the position of said armature means, the overlap areas between said pole surfaces and said armature means being directly proportional to the position of said armature means.

10. An electromagnetic device comprising:

stator means comprising a first closed flux-carrying path including a core and an annular air gap opening in said core defined by first and second concentric cylindrical pole surfaces, and a second closed flux-carrying path including a core and an annular air gap opening in said core defined by third and fourth concentric cylindrical pole surfaces, coil means for generating electromagnetic flux in said first and second closed flux-carrying paths, the direction of flux flow across said annular air gap being substantially radial with respect to said cylindrical pole surfaces, and armature means mounted on said device to be movable between said first and second pole surfaces and between said third and fourth pole surfaces in a plane substantially parallel to said pole surfaces to overlap simultaneously varying areas of said first and third pole surfaces in dependence upon the position of said armature means and to conduct therethrough varying portions of the flux in said first and second closed flux-carrying paths, the direction of flux flow in said armature means remaining substantially radial with respect to said cylindrical pole surfaces.

* * * * *

UNITED STATES PATENT AND TRADEMARK OFFICE

CERTIFICATE OF CORRECTION

PATENT NO. : 4,097,833

DATED : June 27, 1978

INVENTOR(S) : John L. Myers

It is certified that error appears in the above-identified patent and that said Letters Patent are hereby corrected as shown below:

Column 3, line 30, "(dw,/dt)" should be --(dw/dt), --
Column 3, line 58, "where μ is the permeability" is repeated.
Column 4, line 25, "∫" should be included in the formula as $--\int_0^{NI} F d\phi--$ Column 5, line 10, "F = ∇W" should be $--\vec{F} = \vec{\nabla} W$
Column 5, line 48, "and embodiment" should be --an embodiment--
Column 9, line 40, "and said air gap" should be "said air gap--

Signed and Sealed this

Eighth Day of May 1979

[SEAL]

Attest:

RUTH C. MASON
Attesting Officer

DONALD W. BANNER
Commissioner of Patents and Trademarks

UNITED STATES PATENT AND TRADEMARK OFFICE

CERTIFICATE OF CORRECTION

PATENT NO. : 4,097,833

DATED : June 27, 1978

INVENTOR(S) : John L. Myers

It is certified that error appears in the above-identified patent and that said Letters Patent are hereby corrected as shown below:

Printing Errors:

Column 3, line 34, "$e = (Nd\phi dt)$" should be --$e = Nd\phi/dt$--

Column 3, line 55, "$\phi = \frac{F}{R} - \frac{Nl}{\frac{l}{\mu A}} - [\frac{N\mu A}{l}]i$" should be $$--\phi = \frac{F}{R} = \frac{Ni}{\frac{l}{\mu A}} = [\frac{N\mu A}{l}]i--$$

Column 4, line 1, "$W = [\frac{N^2\mu A}{l}] \; {}_0^I idi = [\frac{N^2\mu A}{l}]\frac{I^2}{2}$" should be $$--W = [\frac{N^2\mu A}{l}]\int_0^I idi = [\frac{N^2\mu A}{l}]\frac{I^2}{2}--$$

Typographical Error in Original Application:

Column 3, line 43, "ni" should be --Ni--

Signed and Sealed this

First Day of April 1980

[SEAL]

Attest:

SIDNEY A. DIAMOND

Attesting Officer

Commissioner of Patents and Trademarks